US005512062A

United States Patent [19]

Fuller et al.

[11] Patent Number: 5,512,062

[45] Date of Patent: Apr. 30, 1996

[54] LOW TEMPERATURE TEXTILE DYEING METHOD USING HIGH TEMPERATURE DYE COMPOSITIONS

[75] Inventors: B. Franklin Fuller, Oottewah; Franklin G. Fuller, Chattanooga, both of Tenn.

[73] Assignee: Ful-Dye, Inc., Dalton, Ga.

[21] Appl. No.: 502,184

[22] Filed: Jul. 13, 1995

Related U.S. Application Data

[63] Continuation of Ser. No. 219,114, Mar. 29, 1994, abandoned.

[51] Int. Cl.[6] ..... D06P 5/00; D06B 3/10; C09B 67/00

[52] U.S. Cl. ..... 8/499; 8/611; 8/151; 8/502; 8/929; 8/930; 8/932; 68/205 R; 68/175

[58] Field of Search ..... 8/499, 611, 151, 8/502, 929, 930, 932; 68/205 R, 175

[56] References Cited

U.S. PATENT DOCUMENTS

| | | | |
|---|---|---|---|
| 1,569,915 | 1/1926 | David | 8/611 |
| 1,660,167 | 2/1928 | Kern | 8/595 |
| 2,387,200 | 10/1945 | Walter | 8/636 |
| 2,461,612 | 2/1949 | Olpin | 8/512 |
| 2,532,471 | 12/1950 | Wedler | 8/499 |
| 2,827,357 | 3/1958 | Hannay | 8/500 |
| 2,882,119 | 4/1959 | Laucius | 8/611 |
| 3,271,102 | 9/1966 | Morgan | 8/499 X |
| 3,418,065 | 12/1968 | Blount | 8/426 |
| 3,461,467 | 8/1969 | Duncan | 8/158 |
| 3,558,260 | 1/1971 | Hermes | 8/533 |
| 3,811,836 | 5/1974 | d'Albignac | 8/611 |
| 3,819,324 | 6/1974 | Binn | 8/403 |
| 3,920,385 | 11/1975 | Bohny | 8/436 |
| 3,920,386 | 11/1975 | Beyer | 8/532 |
| 3,986,831 | 10/1976 | von der Eltz | 8/149.1 |
| 4,047,889 | 9/1977 | Hermes | 8/440 |
| 4,076,496 | 2/1978 | Hamano | 8/509 |
| 4,082,502 | 4/1978 | von der Eltz | 8/476 |
| 4,101,270 | 1/1978 | Fleissner | 8/505 |
| 4,150,947 | 4/1979 | Lang | 8/527 |
| 4,218,218 | 8/1980 | Daubach | 8/550 |
| 4,771,497 | 10/1988 | Fleissner | 8/149.1 |
| 4,786,288 | 11/1988 | Handa | 8/495 |
| 5,104,415 | 4/1992 | Koci | 8/527 |
| 5,199,126 | 4/1993 | Fuller | 8/151 |
| 5,201,959 | 4/1993 | Fuller | 68/9 |
| 5,240,465 | 8/1993 | Palacub | 8/543 |

FOREIGN PATENT DOCUMENTS

| | | | |
|---|---|---|---|
| 1241820 | 11/1968 | United Kingdom | B05C 5/00 |
| 2063943 | 11/1980 | United Kingdom | D06B 21/02 |
| 2125449 | 5/1983 | United Kingdom | D06B 21/00 |

OTHER PUBLICATIONS

Trotman, Dyeing and Chemical Technology of Textile Fibers, pp. 308–311, 1984.

*Primary Examiner*—Margaret Einsmann
*Attorney, Agent, or Firm*—Deveau, Colton & Marquis

[57] ABSTRACT

A method, apparatus, and related dye compositions for dyeing textiles which operates at atmospheric pressures, is open to the atmosphere, and does not require the steaming of the textile to set or fix the dye to the textile; specifically, a multi-temperature textile dyeing method which achieves a more complete and even dyeing of the textile in a shorter period of time.

25 Claims, 3 Drawing Sheets

LOW TEMPERATURE TEXTILE DYEING METHOD USING HIGH TEMPERATURE DYE COMPOSITIONS

This is a continuation of application Ser. No. 08/219,114 filed on Mar. 29, 1994 now abandoned.

BACKGROUND OF THE INVENTION

1. Field of the Invention

This invention relates to the dyeing of textiles and, more particularly, to a method, an apparatus, and related dye compositions for dyeing textiles which operates at atmospheric pressure, is open to the atmosphere, and does not require the steaming of the textile to set or fix the dye to the textile. Specifically, this invention is a complete low temperature textile dyeing method which achieves a more complete and even dyeing of the textile in a shorter period of time using a dye composition capable of withstanding high temperatures without boiling or degrading 2. Prior Art Conventional methods and apparatuses for dyeing textiles require the steaming of the textile to set or fix the dye to the textile after the dye has been applied to the textile. For example, the typical textile dyeing method and apparatus involves the application of a dye to the pile surface of the textile, fixing the dye onto the textile pile by steaming and then subjecting the textile to various other finishing procedures prior to drying the textile. The use of a steam fixator generally entails the use of a pressure vessel and/or other high pressure equipment. Further, because steaming generally takes place within the dyeing apparatus, steam can dilute the final color of the dye and, as it condenses into water, can dilute the actual dye composition itself. Because of these disadvantages it would be preferable to have a dyeing apparatus and method which does not require the use of steam. Various steam-based apparatuses and methods are known and discussed below.

The patent assigned to Vepa AG, U.S. Pat. No. 4,101,270, discloses a conventional method for dyeing textile which includes the steps of advancing a continuous textile web through a preshrinking station, moistening the textile web, dyeing the textile web using applicator rolls and/or dye applicators, and then fixing the dye onto the textile web by passage through, for example, a chamber containing steam. This basic method generally forms the base for the other prior art textile dyeing systems and is well known in the art as an example of the use of a steam fixator. Likewise, the patent to Fleissner, U.S. Pat. No. 4,771,497, discloses a process for the continuous treatment of a textile web material involving the application of a dye to the pile surface of the textile and then initiating the dye fixation onto the pile surface by steaming. Many of the prior art patents such as the two disclosed above involve such a steam fixation process and are distinguishable from each other by various additional, optional processes added onto this base dyeing technique.

The patent to von der Eltz et al., U.S. Pat. No. 3,986,831, discloses and claims a high temperature, high pressure batch process for dyeing materials which incorporates a sealed pressure vessel and high-pressure steam fixation. The '831 apparatus and method operate in an essentially air-free environment. Further, the dye fixation disclosed in the '831 patent occurs at a temperature over about 125° C., creating the need for significant energy input. Likewise, the patent to Blount, U.S. Pat. No. 3,418,065, also discloses and claims a high temperature, high pressure batch process which also is carried out in a sealed pressure chamber not open to the atmosphere and which incorporates a steam fixation step. On the contrary, the present invention is open to the atmosphere and does not involve the use of steam or steam fixation. The present process is a continuous process which is carried out on a continuous-running apparatus. Further, the entire process of the present invention can occur at a temperatures below about 115° C., and specifically below 100° C., significantly reducing the energy costs and the apparatus costs.

The patent to Walter, U.S. Pat. No. 2,387,200, also discloses and claims a method for dyeing material which is carried out in a sealed chamber, namely a closed chamber incorporating compressed air and saturated steam. The '200 method is carried out at a temperature substantially above 100° C. and under pressure. Therefore, the '200 method incorporates by its nature a steam fixation step as when the material emerges from the water-based dye bath which is heated substantially above 100° C., the material encounters compressed air and saturated steam under pressure, which is the equivalent of a steam fixation step. The present invention does not comprise a closed or sealed chamber, but is open to the atmosphere, and does not use steam, thus eliminating the steam fixation step which can cause uneven dyeing and running of the dye. Further, the use of an open chamber and lower temperatures allows the present invention to be much more economical in terms of energy costs and apparatus material costs.

The disadvantages of such prior art textile dyeing methods and apparatuses which incorporate steam fixation components is the necessity for the steam fixation step and high pressures. Steam fixation has several disadvantages including the need for a tremendous amount of energy required to heat the steam, dilution of the dye as the steam condenses into water and mixes with the dye, and the cost of the equipment, both in material and time, needed to have a steam fixation step in the textile dyeing process. A further disadvantage is that a textile dyeing process including a steam fixation step is uneconomical to operate when dyeing small batches of textile.

Various other methods, apparatuses and compositions for dyeing textiles have been developed over the years, both at high temperatures, that is 100° C. and above, and at low temperatures, that is below 100° C., at atmospheric pressure and at high pressures, that is above atmospheric pressure, and using dye compositions using polyhydric alcohols, such as glycerol. The most relevant of these methods, apparatuses and compositions are discussed below. With regard to the specific methods and apparatuses, the prior art does not disclose the particular steps or features of this invention which allow a more complete textile dyeing in significantly shorter periods of time, thus reducing energy costs and dye composition costs while increasing the quantity of textile dyed per unit of time.

U.S. Pat. No. 2,461,612 to Olpin et al. discloses a method for dyeing solid articles, such as sheets, rods, and blocks, made of polymerized diallyl phthalate synthetic resins. Dyeing fabrics is not disclosed. The dye composition includes dye, an acid, at least 50% by weight of a polyhydric alcohol such as glycol or glycerol, and, optionally, water. The dye-bath has a claimed temperature from 130° C. to 180° C. This reference discloses that, under ordinary pressure, solutions of dyes in glycerol only can be employed at 140° C. to 180° C. and in an autoclave, under pressure, solutions of dyes in a mixture of glycerol and water can be employed at about 150° C.

U.S. Pat. No. 2,882,119 to Laucius et al. discloses a method of dyeing polyester fabric comprising passing the fabric through a non-aqueous dye-bath including disperse anthraquinone dye, a strong acid, and an alkylene glycol. The bath is maintained at a temperature within the range of 130° C. to 200° C. during dyeing. This patent does not disclose details of the dyeing apparatus and does not disclose whether the apparatus is open or closed, or whether the dyeing is performed under pressure. However, the use of glycol, a known pollutant, is a disadvantage.

U.S. Pat. No. 3,461,467 to Duncan discloses a boil control apparatus for use with an atmospheric dye kettle for dyeing fabrics. The apparatus is open to the atmosphere and specifically is used to prevent boil over of a dye kettle, which uses steam to heat the liquid by injecting steam into the liquid.

U.S. Pat. No. 3,558,260 to Hermes discloses a method for dyeing textiles comprising a mixture of wool and a polyester in a closed aqueous dye-bath comprising benzyl alcohol or a benzyl alcohol/propylene carbonate or dipropylene carbonate mixture maintained at 75° C. to 100° C. The principle of this apparatus is to have a dye liquor flow codirectional with the textile movement, requiring means to create a dye liquor flow, rather than the use of a typical generally static dye bath. U.S. Pat. No. 4,047,889 to Hermes discloses a non-aqueous method for dyeing fabric, preferably polyester, in a high temperature non-aqueous dye-bath wherein the solvent is a high boiling solvent, preferably ethylene glycol. The fabric is dyed at over 300° C. and then washed in a low boiling liquid, preferably methanol. This patent also discloses recycling of the dye, removal of dye from the fabric, and washing of the dyed fabric. The claimed process employs complete recycling of materials, rather than the use of environmentally-friendly materials.

U.S. Pat. No. 4,082,502 to von der Eltz et al. discloses a process for dyeing textiles wherein the textiles are passed through a dye-bath in a pressurized sealed container at temperatures substantially greater than 100° C. in which saturated or superheated steam is used. The dye solution is pre-mixed and heated before entering the bath chamber. The textile is preheated and deaerated by exposure to steam prior to dyeing. Post-dyeing heat treatment is used to fix the dye.

U.K. Patent No. 1241820 discloses a process for dyeing pile carpets in which the fabric is sprayed with a dye composition from nozzles and then heated in a steam chamber. The dye composition can include a boiling point elevation means such as glycol so that dyeing can be done at temperatures greater than 100° C. However, this patent teaches the operation of this process in a steam setting chamber.

U.K. Patent Application No. 2 063 943 discloses a process for dyeing fabric wherein the fabric passes through a dye-bath contained in a pressurized vessel which comprises a high pressure steamer body. The dye-bath is maintained at temperatures greater than 100° C. The dye is mixed and preheated in a vessel separate from the bath chamber. U.K. Patent Application No. 2 125 449 discloses a process for dyeing heat shrinkable polyester knit fabric wherein the fabric is heated before dyeing to shrink and set the fabric. The fabric is dyed under pressure in a loop steamer. In effect, this application discloses a preshrinker.

With regard to the specific dye compositions, while the prior art does disclose glycerin or glycerol in dye compositions, a trihydric alcohol-based category of dye compositions which can be formulated for use in multiple dyeing applications is not disclosed. The specific dye composition formulations allow a more complete textile dyeing using less of the dye composition, thus reducing dye composition costs. For example, an excess amount of dye is carried with the textile from the dye bath and is washed off in the wash box or washing step. This results both in wasted dye and in a more polluted wash stream which must be disposed of in some manner. The present invention significantly reduces the amount of excess dye carried with the textile from the dye bath, resulting in a lower overall dye usage and much cleaner wash streams. Further, the specific dye composition formulations dye the textiles more quickly, thus reducing dyeing time and energy costs. The specific dye compositions also are environmentally friendly and recyclable.

U.S. Pat. No. 1,660,167 to Kem discloses a method of printing on and dyeing textiles using a composition comprising a basic dye, lactic acid, water, a glycerin solution comprising glycerin, formic acid and benzoic acid, and a tannic acid solution comprising tannic acid and lactic acid, mixed with a starch paste and acetic acid. This composition is for use in cold or ordinary temperature applications, and does not require steaming of the fabric, but does require a subsequent fixing of the dye on the fabric by a firming or fixing bath, such as an antimony salt.

U.S. Pat. No. 2,827,357 to Hannay et al. discloses an alkali vat dye based on molten metal bath dyeing. This particular dye has an increased amount of alkali and is not of the polyhydric alcohol class.

U.S. Pat. No. 3,811,836 to d'Albignac et al. discloses a general category of anionic acid dyes which comprises a polyol and a sulphonic or carboxylic acid containing dyestuff which is in the form of a free acid. Synthetic textiles are dyed in 10–120 seconds at a temperature from 90° to 160° C. using this free acid containing dyestuff. Washing in a low boiling point solvent mixture, such as acetone, then is required.

U.S. Pat. No. 3,819,324 to Bino discloses a fugitive dyeing process for polyesters wherein glycerol is used as a solvent. The invention is for distinguishing between two or more differently colorable textiles by subjecting the textiles to an ester, and then treating with an aqueous or alcoholic solution of an acid dye to bring out the color contrast. The color, being fugitive, can be easily scoured from the textile, so the textile can be redyed.

U.S. Pat. No. 3,920,385 to Bohny et al. discloses a process for dyeing leather by contacting the leather with a composition comprising water, dye, an organic solvent such as glycerol, and various additives. The dye-bath temperature ranges from 25° C. to 80° C.

U.S. Pat. No. 3,920,386 to Beyer et al. discloses a process for dyeing cellulose fibers at room temperature comprising contacting the fibers with an aqueous dye-bath including an azo dyestuff, a coupling component, a non-diazotized primary aromatic amine in a solvent such as glycerin, and various other additives. The dye-bath is at room temperature. The fibers are subjected to a post-dyeing heat treatment. This process discloses an alternative dyeing process for cellulose fiber containing fibers.

U.S. Pat. No. 4,076,496 to Hamano discloses a method of dyeing synthetic resin articles such as extruded articles of acrylic resin, polyurethane resin, polyamide resin, polycarbonate resin, acrylonitrile-butadiene-styrene copolymer resin, and polyvinylchloride resin without softening the resin. The method includes dipping the article in a heated solution comprising dye, a polyacid, a polyhydric alcohol such as glycerol, but preferably a dihydric alcohol, and water. There is no fixing step after the dipping. The dye-bath temperatures disclosed are no greater than 90° C. and dyeing of fabric is not disclosed. The polyhydric alcohol is used as a solvent for the acid and is present in the dye solution from 5 to 50% by weight.

U.S. Pat. No. 4,150,947 to Lang et al. discloses concentrated dispersions of water-soluble basic dyestuffs comprising 10 to 80% by weight of a dyestuff free of inorganic salts, 90 to 20% by weight of a dispersion medium comprising a polyhydric alcohol such as glycerol in which the dyestuff is insoluble, and up to 20% by weight water. The boiling point of the dispersion is not below 80° C. and preferably not below 100° C., and has a viscosity of 100 to about 250 cp at 20° C. There is no disclosure of a method for using the dye to color fabric.

U.S. Pat. No. 4,218,218 to Daubach et al. discloses aqueous dye dispersions comprising a dye, a particular surfactant, a mixture of water and a water-retaining agent such as glycerol, and various additives. The glycerol is added to prevent drying-up and encrusting of the fluid formulation. The dispersions are useful in dyeing packages, but no details on the dyeing process are provided.

U.S. Pat. No. 4,786,288 to Handa et al. discloses a process for ink jet dyeing a polymer substrate to produce sharp patterns with a composition comprising glycerol as a carrier. The dye is fixed to the substrate with a post-dyeing steam treatment. The fabric is pretreated with a soluble Group IA or IIA salt and a cationic compounds, and then treated with a copolyester. This is a specific composition which will resist running during application, unlike the common textile dye.

U.S. Pat. No. 5,104,415 to Koci discloses a method for dyeing synthetic textiles wherein glycerol is used as a dye promoter. The formulation comprises a generally water-insoluble dye, a sulfated polyadduct, water, a betain monohydrate, and an anionic dispersant of a particular formula. The dye-bath temperature is 10° to 60° C. This formulation is an alternative dye for printing on synthetic materials. Likewise, U.S. Pat. No. 5,240,465 to Palacin discloses a textile dyeing method wherein glycerin is used as a solubilizing agent. The dye-bath temperatures are between 20° C. and 100° C. This is a process for dyeing cellulosic containing textiles with reactive dyes, using sulphonated ethers or sulphones, and then fixing the dye using an alkali.

This inventor has developed a method an apparatus for dyeing textile which, in its best mode for dyeing carpet, is open to the atmosphere and operates at atmospheric pressure, and at temperatures of 100° C. or greater. The method is covered under U.S. Pat. No. 5,199,126, and the apparatus is covered under U.S. Pat. No. 5,201,959. The development of the open-to-the atmosphere process and apparatus also allows for the dyeing of materials at significantly lower energy costs and with a higher degree of safety. Less energy is necessary as there are no materials to be superheated and no pressure needs to be created. Materials costs are reduced as vessels open to the atmosphere typically do not need the reinforcing required for a pressure vessel. Lastly, pressure operations typically inherently are more dangerous than an equivalent atmospheric operation.

The '126 method and '959 apparatus comprise a novel dye bath applicator which effects the textile dyeing and fixing step by utilizing a high temperature dye mixture, the boiling point of which is higher than the boiling point of water. The apparatus is open to the atmosphere and does not constitute a pressure vessel in the sense disclosed in prior art dyeing apparatuses. By eliminating the need for pressure vessel-type couplings and materials, the apparatus is both much less costly and safer to operate. The apparatus also generally comprises a heated mix tank which effects the heating step of the dye and chemicals, a heat exchanger which effects the step of heating the dye prior to the dye entering the applicator, and wash boxes with overflows which effect the step of neutralizing the pH of the textile and washing the textile before the textile enters the drying stage. No open steam lines are used to heat any dye solutions or chemicals, or to heat any components of the apparatus, including the heated mix tank, used in this invention. Although the '126 method and '959 apparatus originally were developed for use in dyeing carpet, they can be used for dyeing other textiles and at temperatures below 100° C. with excellent results. The present invention was developed as an alternative both to high temperature dyeing and to dyeing carpet by creating a method, apparatus and composition which is equally useful at low temperature and for other textiles.

SUMMARY OF THE INVENTION

This invention generally relates to the dyeing of textiles and, more particularly, to an invention which comprises the use of environmentally friendly dye mixtures having boiling points greater than 100° C., but which can be applied at dyeing temperatures both above and below 100° C., a variable volume dye tank incorporating removable baffles, and variable threading of the textile through the dye tank over a plurality of thread rollers. No open steam lines are used to heat any dye solutions or chemicals, or to heat any components of the apparatus, including the heated mix tank, used in this invention. This invention achieves superior side to side coverage, particularly in the preferred temperature range of 70° to 120° C.

The dye mixtures preferably are applied in an apparatus for dyeing textiles which is open to the atmosphere, which can operate at temperatures both below and above 100° C., and which does not require the steaming of the textile to set or fix the dye to the textile. The dye mixtures can be used in a more efficient, less costly textile dyeing method and apparatus disclosed in previous patents of the developer of this invention and in the specific novel dye application structure disclosed herein. This invention may be used to dye textiles, including carpets, as well as all types of yams, fibers, woven fabrics, knits and other fabric type materials made from, for example, nylon, polyester, wool, cotton, rayon and acrylics. This invention can be used in processes which continuously dye textiles without steaming by the use of a high or low temperature dye applicators, depending on the selected dye and textile, fed at a specific temperature and rate.

When the method, apparatus, and dye mixtures are used together, the textile dyeing operation can be run at a wide variety of speeds, as long as the textile has sufficient dwell time with the dye mixture. The textile dyeing operation can be run at speeds ranging from one meter per minute to 120 meters per minute and faster, with dwell times ranging from less than one second to five seconds or more, depending on the textile being dyed. Using the method, apparatus, and dye mixture, nylon carpet dyes almost instantaneously and needs a very short dwell time, while cottons require a somewhat longer dwell time. However, most textiles will achieve a superior coloring compared to the prior art if subjected to a dwell time of 5 seconds or less in this textile dyeing operation. The variable threading and variable volume features of the apparatus are used to vary the dwell time, along with varying the speed at which the textile travels through the apparatus. Thus, the operator can choose whether to increase or decrease the dwell time of the textile in the dye mixture by increasing or decreasing the dye tank volume using the removable baffles, increasing or decreasing the number of passes through the dye mixture by varying the threading over the thread rollers, and/or varying the speed of the textile travel.

This invention specifically relates to the use of the dye mixtures in a novel dye application structure which effects the textile dyeing and fixing step without the use of steam fixation or the absolute necessity of cold water fixation in an apparatus which is open to the atmosphere and does not constitute a pressure vessel. By eliminating the need for pressure vessel-type couplings and materials, this invention is both much less costly and safer to operate. The general dye composition formula comprises a dyestuff, a wetting agent, an acid or alkali, water, and glycerol. This novel category of dye compositions used in this invention eliminates the need for a steam fixator by use of a unique mixture of chemicals which allows the dye to be fixed onto the textile during the dyeing step, therefore eliminating the need for a steam fixator after the dye application step. Likewise, the novel dye compositions also eliminate the need for further fixation at temperatures below the boiling point of water when used on certain textiles, such as cotton. The process can be run at a wide variety of temperature ranges, but preferably between about 70° C. and 120° C.

The advantages of this invention include the elimination of the need for any steam in the dye fixation process, the elimination of any need for gum, thickeners, or defoamers, and the reduction in the amount of pollutants emanating from the system. Other advantages include the elimination of dye chemical waste, no increase in chemical and dyestuff content, and the need for less water usage in the system, which water can be recycled. Further advantages of this invention include a more uniform dye application to the textile from the side to the center to the side of the textile, better definition, and a less expensive dye process. The present invention can dye a single strand of yarn to a twelve foot (12') (approximately 4 m) wide piece of textile, including carpet, or wider, in a level configuration. It also is economical to dye small dye lots using the dye mixtures and the variable threading and volume of the dye bath structure of the present invention as the dye beck time is reduced significantly compared to the prior art.

Accordingly, it is an object of the present invention to provide a textile dyeing method, apparatus and dye composition which eliminates the need for steam fixation.

It is another object of the present invention to provide a textile dyeing method, apparatus and dye composition which has lower overall dyeing costs than conventional textile dyeing methods and apparatuses, including lower power costs, lower machine costs, lower materials costs, and lower operating costs.

It is yet another object of the present invention to provide a textile dyeing method, apparatus and dye composition which has very limited dye or chemical wastes, has no increase in chemical and dyestuff content, uses less water, and recycles the water which it uses.

It is still another object of the present invention to provide a textile dyeing method, apparatus and dye composition which gives a more uniform dye application from side to center to side and which gives better color definition throughout the textile.

It is another object of the present invention to provide a textile dyeing method, apparatus and dye composition which can dye a single strand of yam all the way up to a twelve foot (12') (approximately 4 m) wide or wider piece of textile, and which is economical to operate when dyeing small dye lots.

It is also an object of the present invention to provide a unique dye solution which can be heated above 100° C., yet applied above, at or below 100° C., and can be fixed to a textile web without the need for steam fixation.

These objects and other objects, features and advantages of the invention will become apparent to those skilled in the art upon reading the following detailed description of the invention taken in conjunction with the following drawings in which like characters of reference correspond to like parts.

DETAILED DESCRIPTION OF A PREFERRED EMBODIMENT

Figure 1:
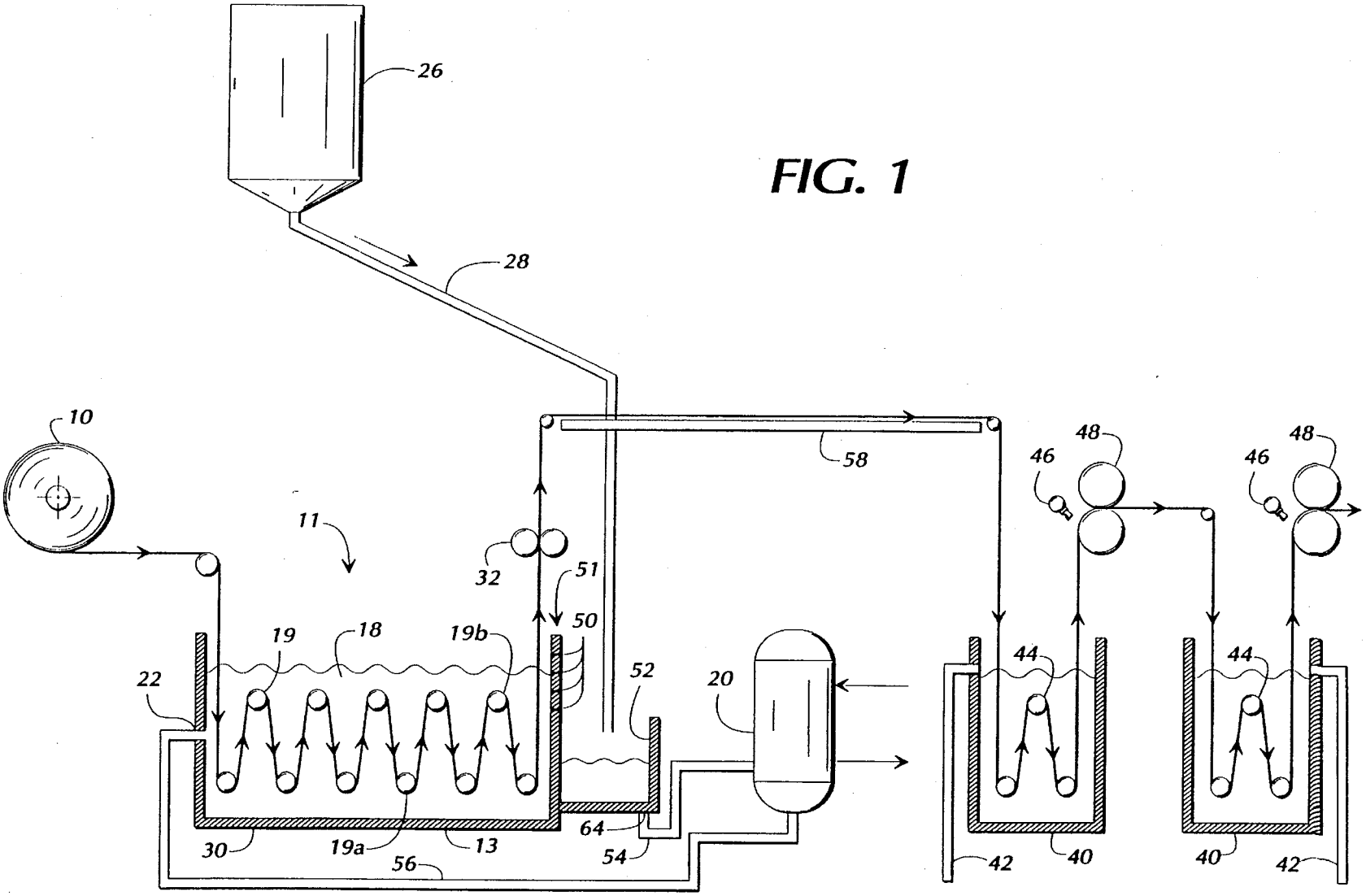
FIG. 1 is a schematic of the preferred general method and apparatus used in the present invention.

A general schematic of the preferred apparatus of the present invention showing the various components necessary to carry out the preferred method is shown in FIG. 1. In general, this invention comprises three primary components: (1) a novel dye application structure; (2) a novel textile dyeing apparatus and method using high temperature dye compositions in either low or high temperature dyeing situations; and (3) a novel polyhydric alcohol-based category of dye compositions for use in textile dyeing.

In this invention, textile is colored by the dye in the dye application structure. The composition of the dye, particularly when used in the dye application structure, allows the dye to be fixed to the textile at that step, thus eliminating the need for a steam fixator or cold water or low boiling point solvent fixation. Additionally, the dye application structure may be heated in a unique way as compared to the method for heating conventional dye baths. For example, the structure may be heated by electric coils or elements or, alternatively, with an enclosed steam system to any temperature, including temperatures greater than 100° C., temperatures which typically cannot be obtained in conventional open systems using dye compositions including a significant amount of water. The method of heating also provides a more direct heat source.

The presence of a steam fixator causes a dilution of the dye solution. Therefore, the elimination of the steam fixation step is important to the invention because the dye solution contains a given concentration of dye, chemicals, and water and any dilution of this solution may affect both the coloring of the textile and the ability of the dye to be heated above 100° C., if desired. As the textile leaves the dye application structure, the textile is squeezed to remove excess dye, which dye is ultimately recycled to the dye application structure. The dye typically is nearly completely fixed on the textile upon leaving the dye application structure. The textile then enters a cold water bath in which the dyeing process is further stopped or fixed, if necessary. Once the dye is fixed, normal variations in color in the textile from side to center to side do not occur, as is common in continuous dyeing with a steam fixation step. The textile then is rinsed in one or more wash boxes with overflow.

This textile dyeing apparatus effects the textile dyeing and fixing step by utilizing a novel category of glycerol-based dye compositions having a boiling point greater than 100° C., but which produce exceptional dyeing quality at temperatures between about 70° C. and 120° C. The apparatus is open to the atmosphere and does not constitute a pressure vessel in the sense disclosed in prior art dyeing apparatuses. By eliminating the need for pressure vessel-type couplings and materials, the apparatus is both much less costly and safer to operate. The apparatus also generally comprises a heated dye composition mix tank which effects the heating step of the dye and chemicals, a heat exchanger which effects the step of heating the dye prior to the dye entering the applicator structure and maintaining the dye at a constant temperature within the applicator structure, and wash boxes with overflows which effect the step of neutralizing the pH of the textile and washing the textile before the textile enters the drying stage.

The novel dye mixture comprises a dye, a wetting agent, water, a polyhydric alcohol and either an acid or an alkali depending on the type of dye used. The preferred polyhydric alcohol has a boiling point higher than 100° C., so as to give the dye mixture a boiling point higher than water at standard temperature and pressure conditions. The preferred category of polyhydric alcohols are the trihydric alcohols, or glycerols, having the general formula $CH_2OH(CHOH)_nCH_2OH$ where n may be from 1 to 5. The nature of the dye mixture allows for more efficient textile dyeing and achieves a superior color result, with less color variation and better side-to-side color conformity, and allows the dye to be fixed to the textile in a room temperature wash step, thus eliminating the need for a steam fixator. Many mixtures of dye, chemicals, water and polyhydric alcohols may be made depending upon the dye desired and the textile to be dyed. Useful dyes include, for example, acid dyes, disperse dyes, direct dyes, basic dyes, vats dyes, fiber reactive dyes, water based dyes, pigments, and any other dyes that can be applied heated to a substrate.

The general formula for the dye solution based on glycerol (trihydric alcohol) is:

GENERAL DYE SOLUTION FORMULA

| Component | Relative Quantity |
|---|---|
| Dyes | 0.50–6.00 g/l |
| Wetting Agent | 0.50–6.00 g/l |
| Acid or Alkali | 0.25–12.00 g/l |
| Water | 1.60–0.80 liters |
| Glycerol | 0.40–1.20 liters |

The preferred quantities of water and glycerol are 1.60 to 0.80 liters of water per 2 liters of dye solution and 0.40 to 1.20 liters of glycerol per 2 liters of dye solution. At dye application temperatures above 100° C., the amount of water and glycerol is roughly equal, each comprising approximately one-half of the final volume of dye solution. The amount of glycerol used is dependent on the temperature the dye is raised to for application. For instance, at application temperatures below 100° C., less glycerol is necessary, while at application temperatures above 100° C., more glycerol is necessary. The quantities of dye, wetting agent, and acid or alkali are expressed in grams of component per liter of dye solution.

Three examples of representative dye solutions are as follows:

| Component | Relative Quantity |
|---|---|
| Dyes (selected acid dyes) | 1.00 g/l |
| Wetting Agent (such as benzyl alcohol 747-alcohol, anionic and nonionic surfactants) | 1.00 g/l |
| Leveling Agent (such as ethoxylated C12–C15 primary alcohol and coconut condensate, nonionic fatty acid condensates with amine, diethanolamine, anionic sulfated and ethoxylated nonylphenol) | 2.00 g/l |
| Acid (such as sulfonic acid, 15% sol., phosohoric acid, formic acid, or citric acid) | 2.00 g/l |
| Water Softener (optional; such as EDTA) | 2.00 g/l |
| Water | 1.60–0.80 liters |
| Glycerol | 0.40–1.20 liters |

The selected acid dyes are first dissolved in a portion of the water great enough to allow for the dissolution of the dyes. Dyeing assistants, such as butyl alcohol and sulfated and ethoxylated nonylphenol, and an acid to control pH, such as sulfamic acid, are then added to the dye/water mixture. These then are combined and mixed with the glycerol, which previously has been mixed with the remainder of the water, to form the dye mixture. The boiling point of this specific dye solution is approximately 108° C.– 110° C. This specific dye solution is particularly useful for nylon tufted textile or other nylon fabrics, acid dyeable polyesters, and wools.

EXAMPLE 2—DISPERSE DYES

| Component | Relative Quantity |
|---|---|
| Dyes (selected disperse dyes) | 1.00 g/l |
| Wetting Agent (optional; such as potassium salt of ethoxylated phosphate alcohol, phosphated DA04) | 2.00 g/l |
| Leveling Agent (such as fatty acid, ethoxylated castor oil) | 1.00 g/l |
| Acid (such as sulfamic acid 15% sol., phosphoric acid, formic acid, citric acid) | 0.50 g/l |
| Water | 1.60–0.80 liters |
| Glycerol | 0.40–1.20 liters |

The dye first is dissolved in a portion of the water great enough to allow for the dissolution of the dye. The water for this specific dye should be hot and a wetting or dispersing agent generally is needed to assist in complete dissolution. A leveling agent and an acid to control the pH, such as sulfamic acid, is then added to the dye/water mixture. This solution is combined and mixed with the glycerol, which previously has been mixed with the remainder of the water, to increase the boiling point of the dye solution. The boiling point of this specific dye solution also is approximately 108° C.– 110° C. This specific dye solution is particularly useful for polyester textile or other fabrics. No carrier is necessary, making this dyeing process more environmentally friendly.

EXAMPLE 3—VAT DYES

| Component | Relative Quantity |
|---|---|
| Dyes (selected vat dyes) | 5.00 g/l |
| Wetting Agent (such as potassium salt of ethoxylated phosphate alcohol, phosphates | 5.00 g/l |

-continued

| Component | Relative Quantity |
|---|---|
| of other alcohols, ethoxylated alcohol, and other salts such as sodium, decyl alcohols, soaps) | |
| Alkali (such as sodium hydroxide, potassium hydroxide) | 10.00 g/l |
| Exhaustion Increasing Agent (optional; such as sodium sulfate, sodium chloride, or other salt, or dextrose) | 10.00 g/l |
| Reducing Agent (such as sodium dithionate, sodium hydrosulfite, thiourea dioxide) | 2.00 g/l |
| Softening Agent (optional; such as EDTA) | 2.00 g/l |
| Water | 1.60–0.80 liters |
| Glycerol | 0.40–1.20 liters |
| Wash Box | |
| Oxidizer/Reoxidizer (such as hydrogen peroxide sodium bromate, sodium dichromate) Alternatively, oxidizing processes such as air contact or skying may be used instead of the oxidizer/reoxidizer. | |

The dye first is dispersed in a portion of the water great enough to allow for the dissolution of the dye, along with the wetting agent. The water for this specific dye may be at room temperature or warmer and the wetting or dispersing agent generally is needed to assist in complete dissolution. The alkali is dissolved in a portion of the water great enough to allow for the dissolution of the alkali. The exhaustion increasing agent, if used, also is dissolved with the alkali in this portion of the water. The dissolved dye in water, with the wetting agent if used, the dissolved alkali and exhaustion increasing agent (if used), the remainder of the water, the glycerin and the softening agent, if used, are mixed together, and heated to approximately 85° C. and the reducing agent is added. After the dye has been applied to the textile, the dye must be reoxidized. This can be accomplished by use of a oxidizer/reoxidizer placed in the first wash box, or by contacting the dyed textile with air using, for example, skying. This specific dye solution is particularly useful for cotton.

The preferred polyhydric alcohol is the trihydric alcohol glycerol. The preferred wetting agents are alcohols, such as benzyl alcohol, 747-alcohol (a mixture of butyl alcohol, diethyleneglycol and water), anionic and nonionic surfactants, potassium salt of ethoxylated phosphate alcohol, (phosphated decyl alcohol with four (4) mols ethylene oxide) phosphates of alcohols, ethoxylated alcohols, salts, decyl alcohols, and soaps. The preferred acids are the Group IVA, VA and VIA acids such as sulfamic acid, phosphoric acid, formic acid, acetic acid, and citric acid. The preferred alkalis are the Group IA and IIA alkalis such as sodium hydroxide and potassium hydroxide.

Additional components, such as dyeing assistants in the form of leveling agents, exhaustion increasing agents, reducing agents, and softening agents are useful. The preferred leveling agents are ethoxylated $C_{12}$–$C_{15}$ primary alcohols, coconut condensate, nonionic fatty acid condensates with amine, diethanolamine, aminonic sulfated and ethoxylated nonylphenol, ethoxylated castor oil, and fatty acids. The preferred exhaustion increasing agents are sodium sulfate, sodium chloride, and other salts, and dextrose. The preferred reducing agents are sodium dithionate, sodium hydrosulfite, and thiourea dioxide. The preferred softening agent is EDTA.

The dye mixtures will dye nylon, polyester, cotton, wool and other fibers utilizing acid, disperse, direct, vat, basic, water based, fiber reactive, and pigment class dyestuffs. The dye mixtures, especially when used with the preferred method and apparatus, also accomplish currently acceptable fastness and crocking performance levels with no steamer unit or other steam requirement for satisfactory color setting. Furthermore, the dye mixtures, especially when used with the preferred method and apparatus, achieve over 90% and near 100% exhaustion of the dye solution and reduces affluent waste in the dye process by approximately 75% and is applicable to certain existing equipment upon modification of that equipment. When the textile comes out of the dye application unit, the color shade is fully developed and will not continue to build in color department. Further, the water used in the wash box can be recycled with simple plumbing additions.

Figure 3:
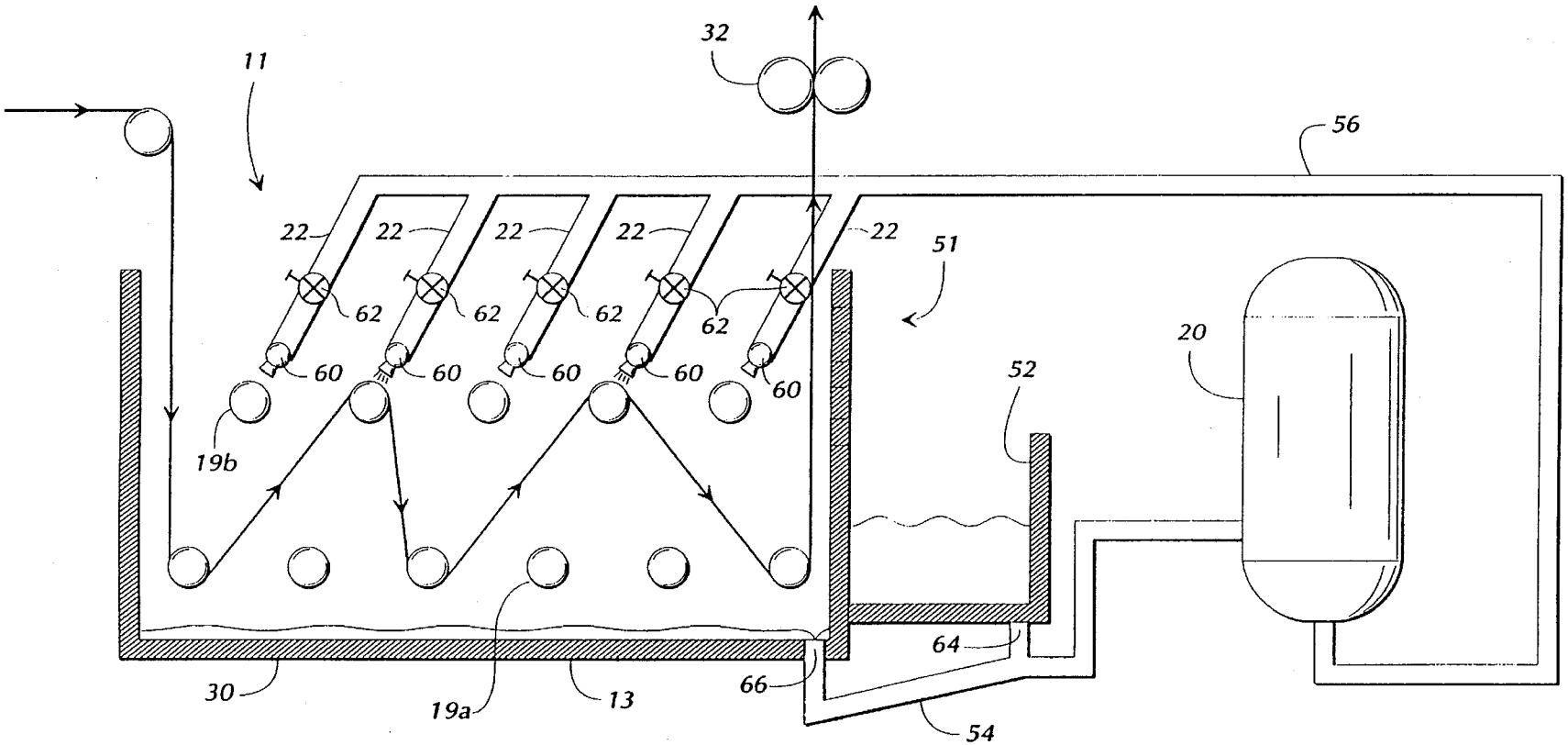
FIG. 3 is a schematic of the preferred dye bath structure used in the present invention in an alternate embodiment using jet applicators.

Referring now to FIG. 1, a general schematic of the novel dye application structure 11 is shown in conjunction with an entire dyeing apparatus developed to best utilize the application structure 11. The application structure 11 comprises tank 13, thread rollers 19 or applicator spray jets 60 (as shown in FIG. 3), removable baffles 50, overflow tank 52, dye composition inlet ports 22, dye composition feed line 56, and dye composition outlet line 54. The dye composition is heated and reheated in heat exchanger 20 by heat exchange with a closed loop of heated glycol or the like. The dyeing method of the present invention is continuous and unidirectional as shown by FIG. 1.

The dye composition is stored in dye vat 26 and, when needed, is fed to the apparatus via feed line 28 to overflow tank 52. From overflow tank 52, the dye composition is pumped through heat exchanger 20 to be heated to the predetermined dyeing temperature, preferably between 70° C. and 120° C. The heated dye composition is pumped through dye composition feed line 56 either directly to tank 13 or to spray jets 60 through inlet ports 22.

Figure 2:
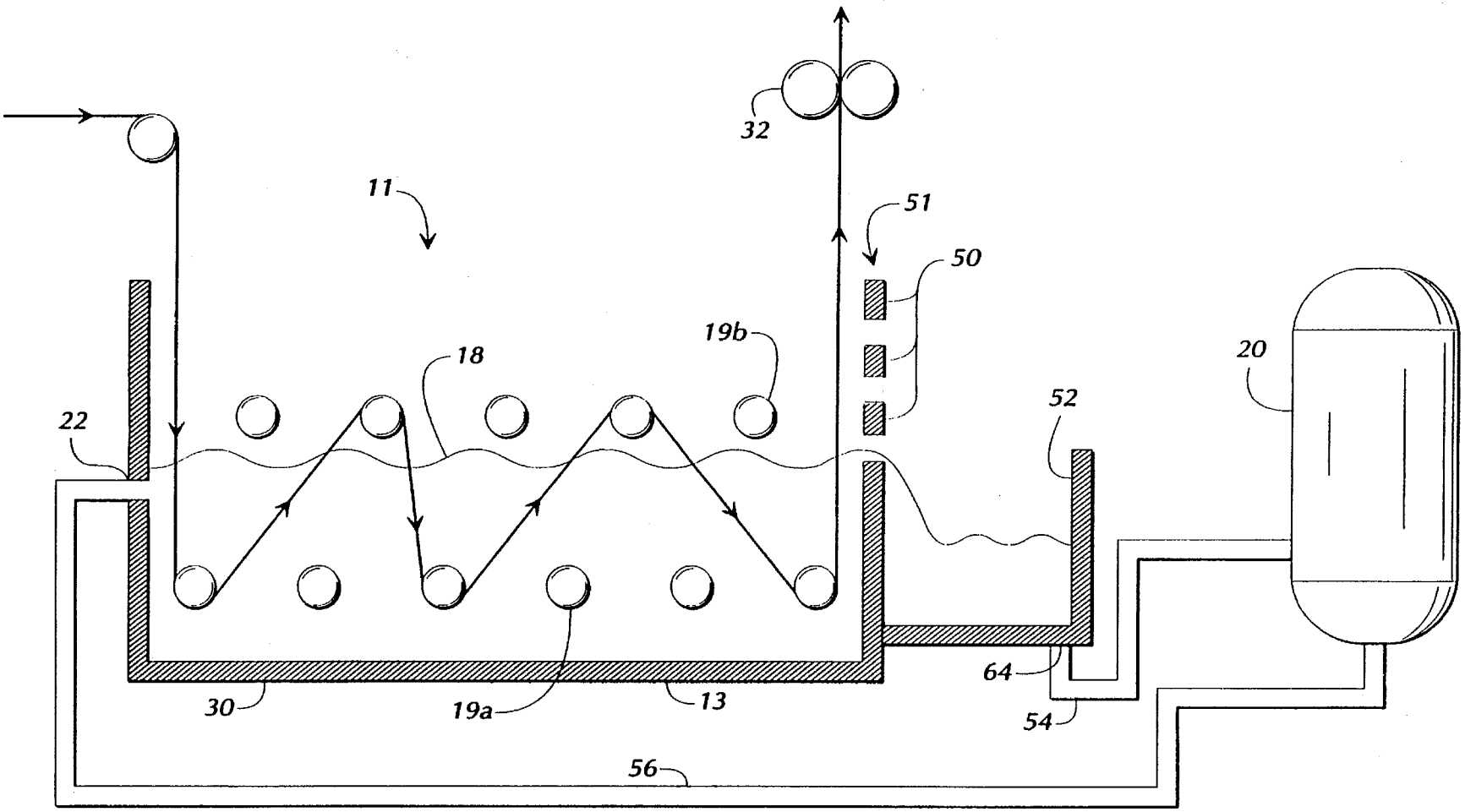
FIG. 2 is a schematic of the preferred dye bath structure used in the present invention showing the removable baffles and variable threading.

The dye application structure 11 is shown in enlarged detail in FIG. 2 and FIG. 3. If the structure 11 is used as a submergence dye bath, the tank 13 is filled with dye solution 18 to contact at least the bottoms of the lower level of thread rollers 19*a*. As shown in FIG. 1, the dye solution 18 completely covers both the lower level of thread rollers 19*a* and the upper level of thread rollers 19*b*, while in FIG. 2, the dye solution 18 only covers the lower level of thread rollers 19*a*. In these configurations, the thread rollers 19 act as applicators. In this configuration, excess dye solution exits tank 13 over baffle wall 51 into overflow tank 52, where it is recirculated through heat exchanger 20 and back to tank 13.

If the structure 11 is used as a spray applicator, as shown in FIG. 3, one or more jets 60 are associated with each upper thread roller 19*b*. Dye solution 18 is sprayed from the spray jets 60 onto the textile 10 as it threads its way about thread rollers 19. Valves 62 can be used to control spray jets 60 if fewer than all spray jets 60 are used, as shown in FIG. 3 A dye bath is not necessary in the spray jet configuration. In this configuration, any excess dye solution exits tank 13 through a drain 64 or via overflow over baffle wall 51 as described below. A combination jet spray and submergence bath also can be used.

The dye solution 18 level in the tank 13 is maintained using conventional sensor technology or by overflow. Baffle wall 51 is comprised of removable baffles 50 which separate tank 13 from overflow tank 52, and allow dye solution 18 to overflow from tank 13 in a self-regulating manner. Baffles 50 can be removed individually or in sets to vary the height of baffle wall 51, as shown in FIG. 2, so as to set the height and volume of the dye solution 18 in structure 11. In this manner, structure 11 can be configured for different volumes and different bath levels depending on the selected dyeing method. Overflow tank 52 drains into recirculating line 54 which leads to heat exchanger 20. The dye solution 18 from tank 13 is heated to the set temperature by exchanger 20. The dye solution 18 is sent back to tank 13 via return line 56 and dye entrance ports 22. In the jet spray embodiment, the excess dye solution exits tank 13 through drain 69 or through overflow into overflow tank 52 which leads to recirculating line 54. From there, the dye solution follows the same path as discussed above, with the exception that return line 56 leads through inlet ports 22 to spray jets 60.

The textile 10 is taken off a feed roll and fed to the dye application structure 11. Textile 10 is threaded over thread rollers 19 in a generally up-and-down manner. Textile 10 does not need to be threaded over all of thread rollers 19, but as shown in FIG. 2 can be selectively threaded so as to increase or reduce dwell time within the dye solution 18. Likewise, if spray jets 60 are used as shown in FIG. 3, selectively threading textile 10 will subject the textile 10 to a desired numbered of spray jets 60.

The textile 10 may first enter an optional preheater (not shown) before it enters the dye solution 18 in tank 13. The preheater generally comprises a preheating chamber which also is open to the atmosphere and operates at atmospheric pressure. The purpose of the preheater is to heat the textile 10 prior to it entering the dye solution 18 in tank 13. Preheating of the textile 10 keeps the dye solution 18 in tank 13 from cooling down and helps open dye sites on the textile 10 so that it will be ready to take the dye from the applicators 19 or spray jets 60. The preheater and preheating chamber may be heated using the same heating system (not shown) that heats the dye bath tank 13. The heat system may be any conventional heating system, such as infrared heating, electric coils or enclosed steam. The preheater heats the textile 10 to any selected temperature.

In the dye application structure 11, the textile 10 winds among thread rollers 19. The dye solution 18 is applied to the textile 10 either by rollers 19 or spray jets 60. In the tank 13 the dye solution 18 may be further heated to the preferred temperature of between about 70° C. and about 120° C. by recirculation through heat exchanger 20, or by supplemental heating of tank 13. The textile 10 and the thread rollers 19 are submerged within the dye solution 18 facilitating in the even application of the dye to the textile 10. Alternatively, if spray jets 60 are used, the spray jets 60 extend along the length of the thread rollers 19 facilitating in the even application of the dye to the textile 10. The textile 10 is threaded through the thread rollers 19 by threading up-and-down between the lower level of thread rollers 19*a* and the upper level of thread rollers 19*b*, to ensure even and thorough dye application. In the dye tank 13, the textile 10 is submerged in the dye solution 18 as it passes under, over, and under the thread rollers 19. Additional levels of thread rollers 19 may be included for various dyeing applications. Often, four levels of thread rollers 19 are used to ensure even dyeing of the textile 10.

After the dye solution 18 has been applied to the textile 10, the textile 10 leaves the dye tank 18 and passes through optional squeeze rollers 32 to remove excess dye solution 18. The squeeze rollers 32 are located above either the dye tank 13 or the overflow tank 52 such that any excess dye solution 18 squeezed from the textile 10 falls back into the dye tank 13 or the overflow tank 52 in a recycle fashion. As the excess dye solution 18 likely has cooled somewhat, it is preferable to have the excess dye solution 18 fall back into overflow tank 52, where it will be recirculated through heat exchanger 20 prior to being reintroduced to tank 13. After having the excess dye solution squeezed from the textile 10 by the squeeze rollers 32, the dyed textile exits the dye bath structure 11.

The dyed textile 10, which generally does not still contain excess dye solution from the dye application process after passing through squeeze rollers 32 when the preferred dye composition is used, may next pass through an optional vacuum extractor (not shown). The vacuum extractor is a conventional unit which further removes excess dye solution 18 from the dyed textile 10 through a vacuum means. Any excess dye solution 18 removed from the textile 10 by the vacuum extractor is returned to the tank 13 or preferably overflow tank 52 through a recycle. The excess dye solution, therefore, is recycled back to the dye bath tank 13 for dyeing further textile.

After the dyeing step, the textile may pass right to wash boxes 40, or may be subjected to skying (oxidizing) in a skying means. Certain textiles, after they have been dyed, require oxidation. The oxidation can be provided by contacting the dyed textile to an oxidative compound, such as air. Skying means are well-known in the art, and any conventional skying means can be used.

The dyed textile passes next to one or more wash boxes 40. The purpose of wash box 40 is to wash off excess dye solution and chemicals, and to clean the textile from any other debris which may have been picked up during the dyeing process. The wash box 40 uses a water bath with a neutral pH for the cleaning purpose. A further effect of the water bath is to aid in halting the dyeing process and to aid in fixing the dye on the textile 10 surface, if necessary.

In operation, the textile 10 travels between one or more rollers 44 in the wash box 40 to increase the amount of time the textile 10 is in the water bath. Upon leaving the wash box 40, the textile 10 passes by a spray washer 46 which also acts as the water introduction unit to the wash box 40. After being sprayed with water by the spray wash 46, the textile 10 passes through squeeze rollers 48 to remove excess water. In some applications, it is advantageous to have a plurality of wash boxes 40 which generally are identical with each other. Each wash box 40 also is equipped with an overflow 42 to maintain a constant level of water in the wash box 40. After leaving the wash box 40, the textile 10 is dried in a conventional manner, using conventional textile drying apparatus.

The above method, apparatus and composition will dye nylon, polyester, cotton, wool and other fibers utilizing acid, disperse, direct, basic, vat, water based, fiber reactive, pigments, and other classes of dyestuffs. The above method, apparatus and composition when utilized with the appropriate apparatus also accomplishes currently acceptable fastness and crocking performance levels with no steamer unit or other steam requirement for satisfactory color setting. Furthermore, the process of this invention when utilized with the appropriate apparatus achieves near 100% exhaustion of the dye solution and reduces affluent waste in the dye process by approximately 75% and is applicable to certain existing equipment upon modification of that equipment. When the textile comes out of the dye bath the color shade is fully developed and will not continue to build in color department. Further, the water used in the wash box can be recycled with simple plumbing additions (not shown).

The entire dyeing apparatus and the novel dye bath structure can be retrofitted to most existing textile dyeing equipment of the continuous range variety. The primary change would be to install the dye application structure in line with the existing equipment. The existing steamer can be removed from the existing equipment as it is no longer needed, and the dye application structure may be installed in its place. Alternatively, the dye application structure may be placed immediately before the existing steamer with the textile first traveling through the dye application structure, then through the existing steamer, then to the washing system. If this alternative is utilized, the existing steamer need not be turned on as it is unnecessary. Likewise, the dye application structure may be placed immediately after the existing steamer with similar results.

This invention can be applied to all continuous dye ranges for textile and carpet dyeing and to all forms of yam dyeing such as, for example, warp, skein and knit-deknit, space, and denim dyeing. This invention produces superior side to side color matching on continuous dye ranges and produces improved tuft definition and hand in saxony and velvet cut pile constructions. Furthermore, this invention has no practical limitation on speed other than the equipment speed limitations. Textile dyed by the present process and apparatus displays superior color characteristics when compared to textiles dyed by conventional dye becks and continuous ranges.

It will be obvious to those skilled in the art that many variations may be made in the embodiment chosen for the purpose of illustrating the best mode of this invention without departing from the scope thereof as defined by the appended claims.

What is claimed is:

1. A continuous unidirectional method for dyeing textile at atmospheric pressure using a polyhydric alcohol based dye composition in which steam fixation of the dye composition on the textile is unnecessary, comprising the steps of:

a. dyeing the textile in a dye tank for containing or receiving said dye composition, said dye tank comprising a plurality of thread rollers and a plurality of spray jet applicators which apply said dye composition;

b. heating said dye composition to a temperature between approximately 70° C. and 120° C.;

c. maintaining a selected dye temperature between about 70° C. and about 120° C. throughout said dyeing steps; and d. subjecting the textile to a selected amount of said heated dye composition for a selected time by variable threading of the textile through the dye tank about said plurality of thread rollers;

said dye composition comprising from 20–60% by volume of a polyhydric alcohol selected from the group consisting of trihydric alcohols, from 80–40% by volume water, from 0.25 to 12.00 g/l of an acid selected from the group consisting of Group IVA, VA and VIA acids or an alkali selected from the group consisting of Group IA and IIA hydroxides, from 0.50 to 6.00 g/l of a wetting agent selected from the group consisting of alcohols, soap and surfactants, and from 0.50 to 6.00 g/l of a dyestuff selected from the group consisting of acid, disperse, vat direct, basic, pigment, and fiber reactive dyestuffs.

2. The method as claimed in claim 1, wherein said spray jet applicators are discretely associated with a selected quantity of said plurality of thread rollers, with at least one of said spray jet applicators being associated with each one of said selected quantity of said plurality of thread rollers.

3. The method as claimed in claim 1, said dye composition further comprising leveling agents, exhaustion increasing agents, reducing agents and softening agents.

4. The method as claimed in claim 1, wherein said dye tank is open to the atmosphere and is at atmospheric pressure.

5. The method of claim 1, wherein said dye composition comprises an alkali.

6. The method of claim 5, wherein said selected dye temperature is from between 70° C. to 100° C.

7. The method of claim 5, wherein said selected dye temperature is from between 100° C. to 120° C.

8. The method as claimed in claim 6, wherein said alkali is selected from the group consisting of sodium hydroxide and potassium hydroxide and said wetting agent is selected from the group consisting of benzyl alcohol; a mixture of butyl alcohol, diethyleneglycol and water; anionic and nonionic surfactants; ethoxylated alcohols;and soaps.

9. The method as claimed in claim 6, wherein said alkali is selected from the group consisting of sodium hydroxide and potassium hydroxide and said wetting agent is selected from the group consisting of benzyl alcohol; a mixture of butyl alcohol, diethyleneglycol and water; anionic and nonionic surfactants; ethoxylated alcohols; and soaps.

10. The method of claim 1, wherein said dye composition comprises an acid.

11. The method as claimed in claim 10, wherein said selected dye temperature is from between 100° C. to 120° C.

12. The method as claimed in claim 11, wherein said acid is selected from the group consisting of sulfamic acid, phosphoric acid, formic acid, acetic acid, and citric acid and said wetting agent is selected from the group consisting of benzyl alcohol; a mixture of butyl alcohol, diethyleneglycol and water; anionic and nonionic surfactants; ethoxylated alcohols; and soaps.

13. The method as claimed in claim 10, wherein said selected dye temperature is from between 70° C. to 100° C.

14. The method as claimed in claim 13, wherein said acid is selected from the group consisting of sulfamic acid, phosphoric acid, formic acid, acetic acid, and citric acid and said wetting agent is selected from the group consisting of benzyl alcohol; a mixture of butyl alcohol, diethyleneglycol and water; anionic and nonionic surfactants; ethoxylated alcohols; and soaps.

15. The method as claimed in claim 14, wherein said dye composition comprises from 20–60% by volume of the polyhydric alcohol; from 80–40% by volume water; from 0.50 to 6.00 g/l dyestuff; from 0.50 to 6.00 g/l wetting agent; and from 0.25 to 12.00 g/l acid.

16. The method as claimed in claim 15, wherein all of said plurality of thread rollers are at least partially submerged in said dye bath.

17. The method of claim 15, wherein said dye composition comprises an acid.

18. The method of claim 17, wherein said selected dye temperature is from between 70° C. to 100° C.

19. The method as claimed in claim 18, wherein said acid is selected from the group consisting of sulfamic acid, phosphoric acid, formic acid, acetic acid, and citric acid and said wetting agent is selected from the group consisting of benzyl alcohol; a mixture of butyl alcohol, diethyleneglycol and water; anionic and nonionic surfactants; ethoxylated alcohols; and soaps.

20. The method of claim 17, wherein said selected dye temperature is from between 100° C. to 120° C.

21. The method as claimed in claim 20, wherein said acid is selected from the group consisting of sulfamic acid, phosphoric acid, formic acid, acetic acid, and citric acid and said wetting agent is selected from the group consisting of benzyl alcohol; a mixture of butyl alcohol, diethyleneglycol and water; anionic and nonionic surfactants; ethoxylated alcohols; and soaps.

22. The method of claim 15, wherein said dye composition comprises an alkali.

23. The method of claim 22, wherein said selected dye temperature is from between 100° C. to 120° C.

24. The method of claim 22, wherein said selected dye temperature is from between 70° C. to 100° C.

25. The method as claimed in claim 24, wherein said alkali is selected from the group consisting of sodium hydroxide and potassium hydroxide and said wetting agent is selected from the group consisting of benzyl alcohol; a mixture of butyl alcohol, diethyleneglycol and water; anionic and nonionic surfactants; ethoxylated alcohols; and soaps.

* * * * *